US005607289A

United States Patent [19]

Sills

[11] Patent Number: 5,607,289

[45] Date of Patent: Mar. 4, 1997

[54] UNDERWATER EXCAVATION APPARATUS

[75] Inventor: Nicholas V. Sills, Kincardine, United Kingdom

[73] Assignee: Underwater Excavation Ltd., Aberdeen, United Kingdom

[21] Appl. No.: 568,526

[22] Filed: Dec. 7, 1995

Related U.S. Application Data

[63] Continuation of Ser. No. 133,095, Oct. 13, 1993, Pat. No. 5,480,291.

[51] Int. Cl.[6] ..... F04B 35/02

[52] U.S. Cl. ..... 417/375; 415/80; 173/DIG. 2

[58] Field of Search ..... 417/406, 405, 417/375; 415/80, 81; 173/DIG. 1

[56] References Cited

U.S. PATENT DOCUMENTS

| | | | |
|---|---|---|---|
| 69,294 | 9/1867 | Wynkoop | 415/69 |
| 191,668 | 6/1877 | Good | 415/69 |
| 290,039 | 12/1883 | Griffith | 415/63 |
| 2,225,412 | 12/1940 | Ferling | 417/405 |
| 2,705,051 | 3/1955 | Hauser | 416/20 R |
| 2,920,813 | 1/1960 | Goldschmeid | 417/406 |
| 3,286,984 | 11/1966 | Bachl | 415/69 |
| 3,398,694 | 8/1968 | Lerch | 417/375 |
| 3,786,875 | 1/1974 | Merle | 173/DIG. 1 |
| 3,910,728 | 10/1975 | Sloan | 417/405 |
| 3,926,534 | 12/1975 | Erickson | 415/89 |
| 4,138,202 | 2/1979 | Eller | 417/405 |
| 4,452,566 | 6/1984 | Kardas | 415/81 |
| 4,756,671 | 7/1988 | Grimes | 417/405 |
| 5,263,814 | 11/1993 | Jang | 415/80 |

FOREIGN PATENT DOCUMENTS

| | | | |
|---|---|---|---|
| 2033060 | 5/1980 | United Kingdom | 417/405 |
| 2240568 | 2/1990 | United Kingdom . | |
| 87/04743 | 8/1987 | WIPO . | |

*Primary Examiner*—Timothy Thorpe
*Assistant Examiner*—Peter C. Korytnyk
*Attorney, Agent, or Firm*—Flehr, Hohbach, Test, Albritton & Herbert

[57] ABSTRACT

This disclosure relates to an underwater excavation apparatus comprising a tube in which a propeller is mounted for rotation. The tips of the propeller blades are formed with jets supplied from a high-pressure water supply through passages in the propeller blades. The jets impinge on vanes mounted on the tube wall around the propeller to cause the propeller to rotate and thereby draw water through the tube from a inlet at one end to an outlet at the other end to act on the seabed. The apparatus is particularly useful for excavating trenches on the seabed and exposing previously covered installations on the seabed.

14 Claims, 7 Drawing Sheets

SECTION THROUGH 2-2 (FIG. 1)

UNDERWATER EXCAVATION APPARATUS

RELATED APPLICATION

This application is a continuation of application Ser. No. 08/133,095 filed Oct. 13, 1993, now U.S. Pat. No. 5,480,291.

FIELD OF THE INVENTION

This invention relates to underwater excavation apparatus and is particularly, although not exclusively, applicable to underwater excavation apparatus as described and illustrated in our European Patent Publication No. 0289520.

DESCRIPTION OF BACKGROUND ART

European Patent Publication No. 0289520 describes and illustrates an underwater excavation apparatus comprising a tube in which a propeller is mounted which, when energized, produces an unrestricted flow of water of sufficient volume and velocity to carry away sea-bed material. The propeller is driven by a motor mounted in the steel tube and connected via an umbilical to a power supply at the surface.

SUMMARY OF THE INVENTION

This invention provides underwater excavation apparatus comprising a hollow body having an inlet to receive water, an outlet for discharge of water, a propeller mounted for rotation in the hollow body to draw water through the inlet and deliver a stream of water through the outlet, water jet means on the propeller for rotating the propeller and means to supply water under pressure to the jet means to cause the propeller to rotate and thereby draw water into the body through the inlet and deliver a flow of water through the outlet for displacing material on the seabed.

The excavation apparatus may be traversed independently over the seabed or may be used in combination with a drill string extending to the seabed with the hollow body mounted at the lower end of the drill string to displace material below the drill string.

BRIEF DESCRIPTION OF THE DRAWINGS

The following is a description of some specific embodiments of the invention, reference being made to the accompanying drawings in which.

DETAILED DESCRIPTION OF THE PREFERRED EMBODIMENTS

Figure 1:
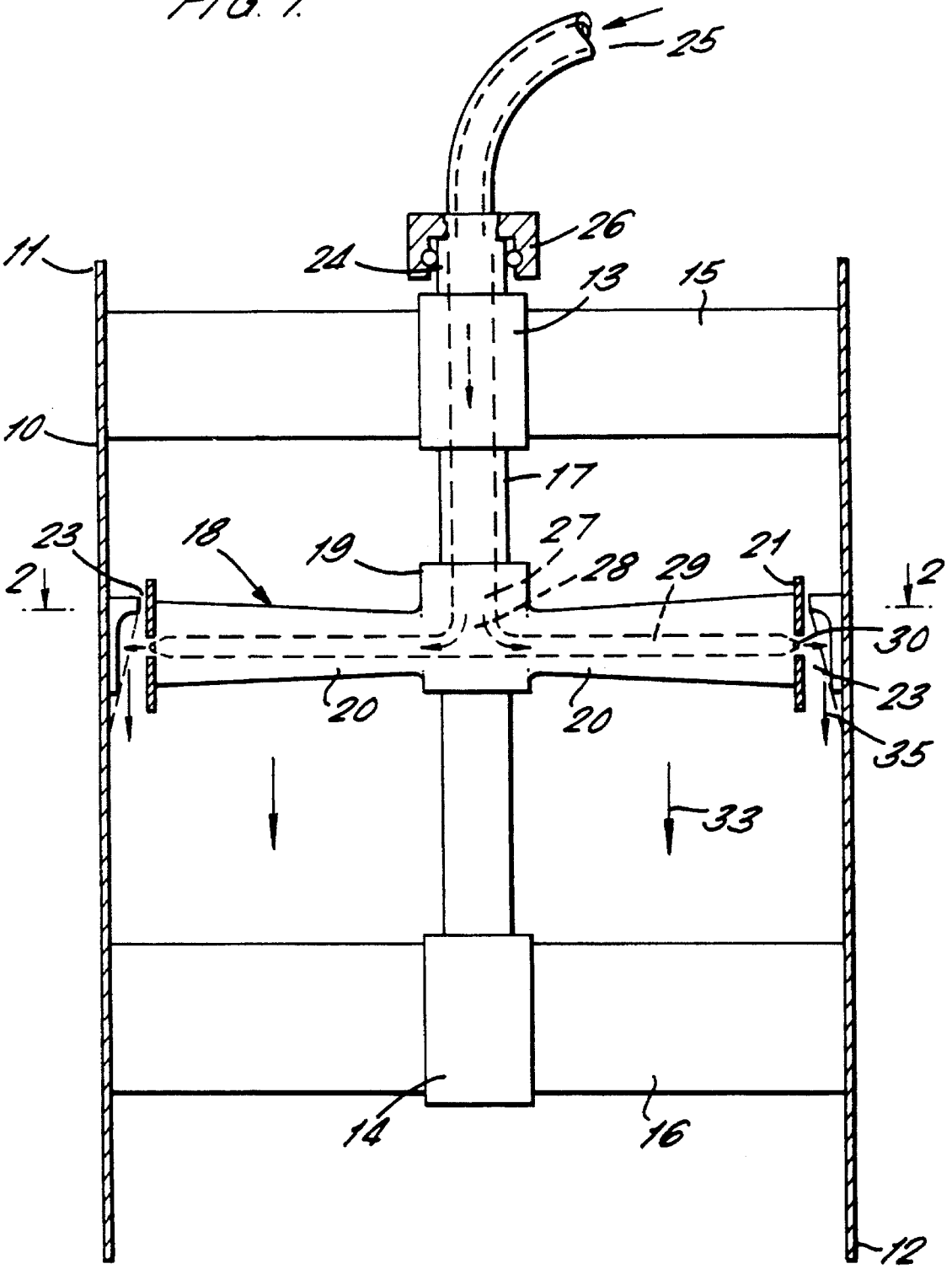
FIG. 1 is a vertical section through an underwater excavation apparatus.

The drawings illustrate an underwater excavation apparatus comprising a hollow cylindrical tube 10 disposed with its axis extending vertically and having an upper, inlet end 11 through which water may be drawn into the tube and a lower outlet end 12 from which water may be discharged from the tube.

Two bearing housings 13, 14 are mounted at spaced locations along the axis of the tube on sets of vanes 15, 16 which extend radially between the housings and the inner periphery of the tube. By way of example, each set of vanes may comprise four vanes. The vanes 15, 16 lie in planes extending lengthwise of the tube for a further purpose to be described later.

A shaft 17 extends between and is mounted for rotation in the bearing housings 13, 14 to carry a propeller indicated at 18 disposed on the shaft between the housings. The propeller comprises a hub 19 secured to the shaft and four (or more) outwardly extending blades 20. A sleeve 21 encircles and is secured to the tips 22 of the blades, the sleeve forming a narrow annular gap 23 with the inner side of the tube 10.

The shaft 17 has an upper end 24 which projects through a bearing housing 13 and an umbilical 25 carrying a high pressure water supply is connected to the upper end of the shaft by means of a high pressure water slip ring 26 to allow the shaft to rotate with respect to the umbilical. The shaft 17 is formed with a throughway 27 extending from its upper end 24 to the region located within the propeller hub 19. The throughway 27 opens into a manifold 28 formed in the shaft connected to radial passages extending through the wall of the hub 19 to passages 29 extending outwardly through the propeller blades 20. Towards the blade tips, the passages 29 are angled forwardly in a clockwise direction as seen from above (in FIG. 2) and terminate in forwardly and outwardly angled jets 30 in the wall of the sleeve 21.

The jets 30 from the blade tips react against a ring of fixed reaction blades or vanes 31 mounted in the tube disposed around the perimeter of the sleeve 21. The blades 31 extend lengthwise of the tube 10, and taper towards the outlet end of the tube. The vanes are concavely curved towards the jets 30 and as best seen in FIG. 2 chambers are formed between adjacent vanes within the tube 10 and around the sleeve 21 into which the jets discharge successively to maximize the reaction of the jets on the blades.

Figure 2:
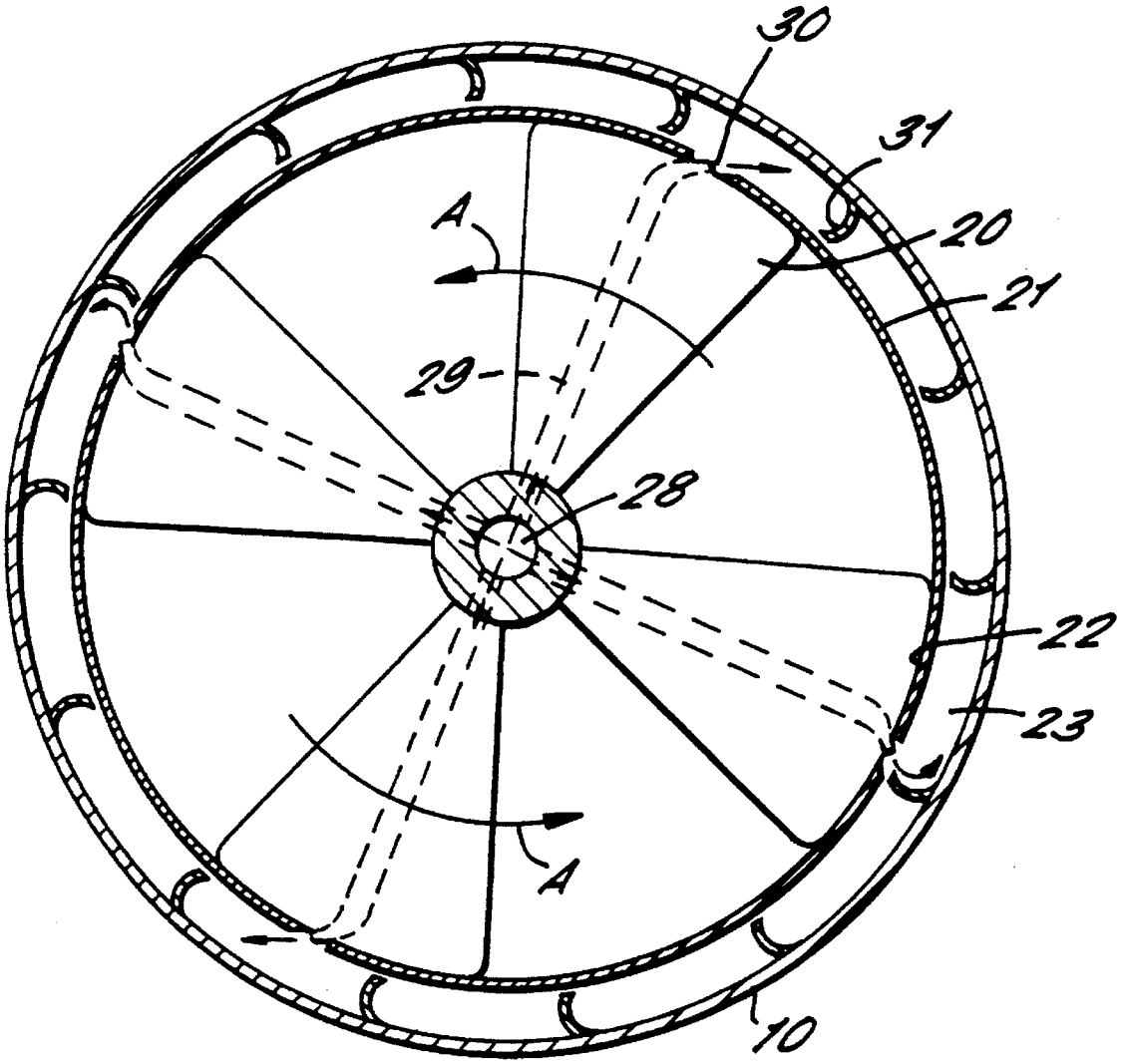
FIG. 2 is a horizontal section on the line 2—2 on FIG. 1.

Water from the jets 30 supplied from the umbilical 25 via the hollow shaft 17 and passages 29 reacts on the fixed reaction vanes 31 causing the propeller 18 to rotate in the direction indicated by the arrows A in FIG. 2 to draw water through the tube 10 from the inlet 11 along the tube in the direction of the arrow 33, and to be discharged at the outlet 12. Water delivered from the jets 30 having reacted with the fixed vanes 31 also passes downwardly from the passage 23 between the sleeve 21 and tube wall 10 as indicated by the arrows 35.

The fixed vanes 15 and 16 in the tube supporting the hubs 13 and 14 for the propeller shaft 17 reduce swirl in the flow of water through the tube so that a substantial linear flow of water is discharged from the tube. The discharge is used to act on the seabed to displace loose material such as sand or silt forming the seabed for creating a pipeline trench, or filling a trench in or any other similar purpose.

The arrangement shown in the drawings, the tube 11 has an opened topped inlet so that water is drawn in to the tube and discharged from the tube in the same direction. In a further form of the invention shown in FIGS. 3 and 7, the inlet to the tube is formed by a downwardly facing annular inlet 38 into the tube around the upper end thereof so that water is drawn into the tube in the opposite direction from that in which it is discharged whereby the reaction of drawing water in counteracts the discharge thrusts. The arrangement of the annular inlet is provided by a top hat shaped upper end wall 39 extending over the upper end of the tube to provide a downwardly facing annular inlet around the outer periphery of the tube and to cause water flow to reverse in passing from the inlet into the upper end of the tube.

The aforesaid vanes 15, 16 which reduce swirl in the water flow along the tube also have the effect of counter-acting torque generated by the action of the propeller in rotating within the tube. Thus the constraint required to maintain the tube at a required level and against rotation is minimized.

Figure 3:
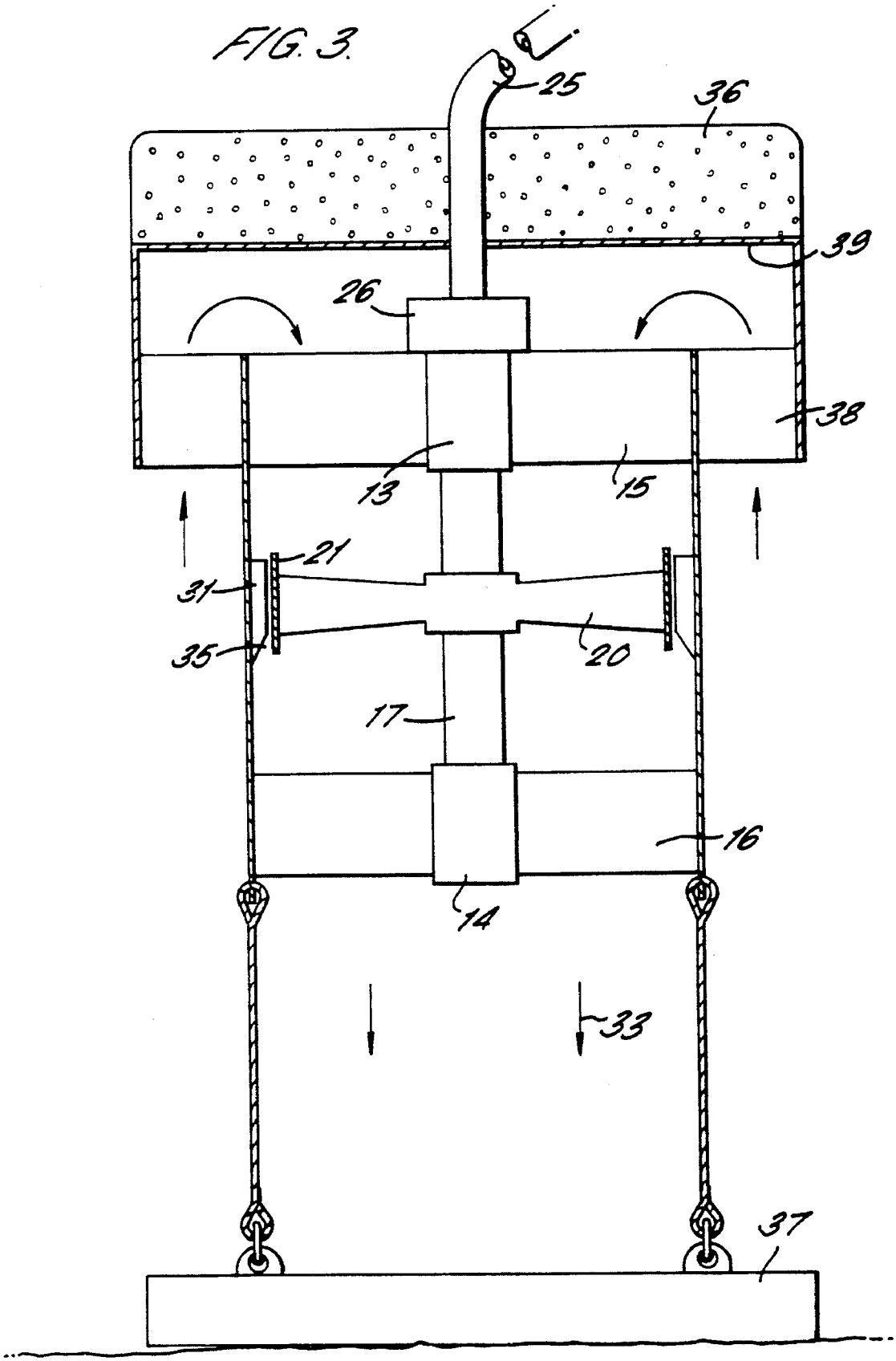
FIG. 3 is a vertical section through a preferred form of the excavation apparatus.

The tube 10 is in use in the upright position shown in FIG. 3 supported by means of a flotation pad 36 secured to the top hat end wall 39 to render the upper end of the tube buoyant. The lower end of the tube is connected by an anchor arrangement 37 to the seabed. The anchorage arrangement is designed to allow the tube to be progressed along the seabed to displace material on the seabed as required.

Figure 4:
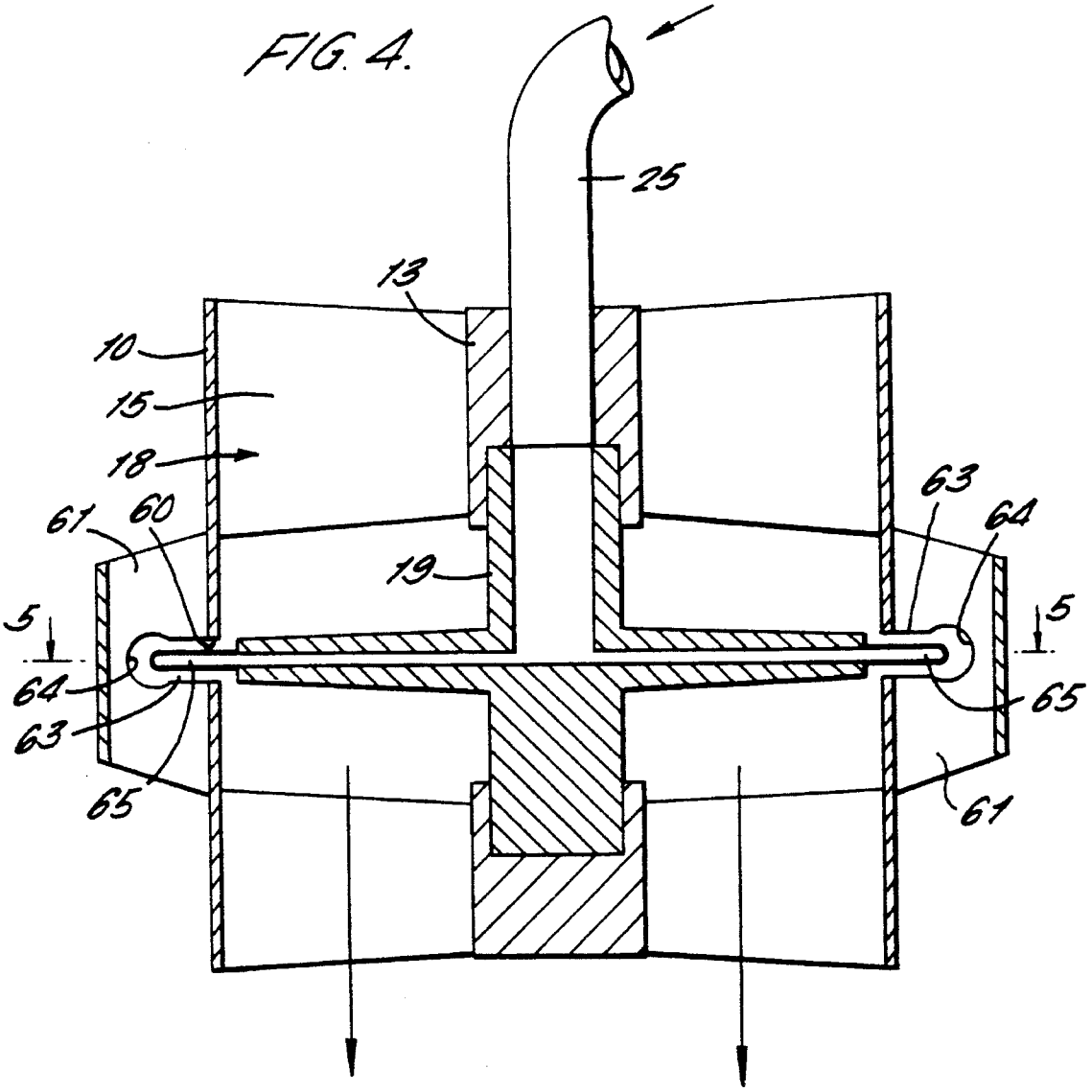
FIG. 4 is a vertical section through a still further form of underwater excavation apparatus.
Figure 5:
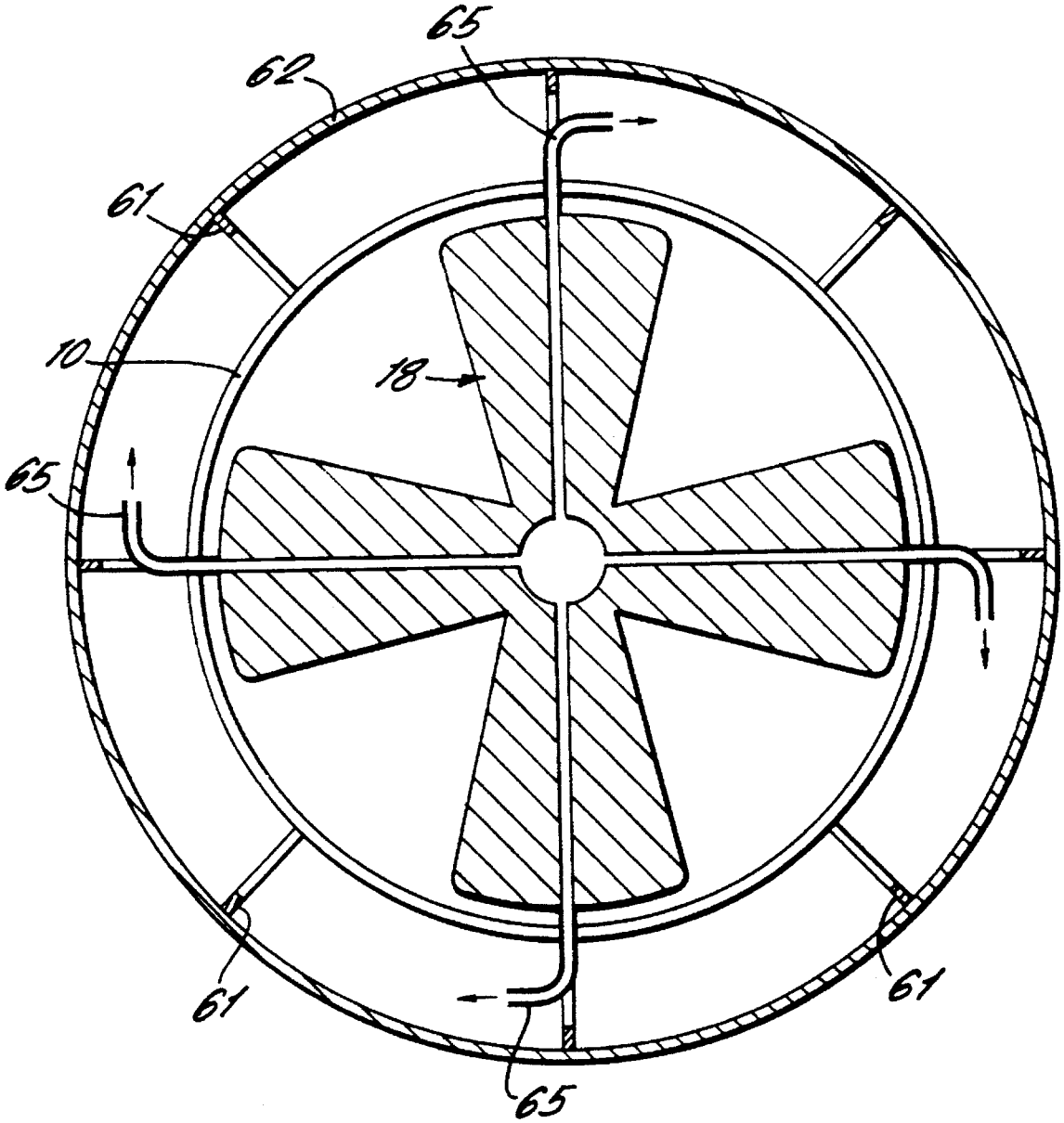
FIG. 5 is a horizontal section on the line 5—5 of FIG. 4.
Figure 7:
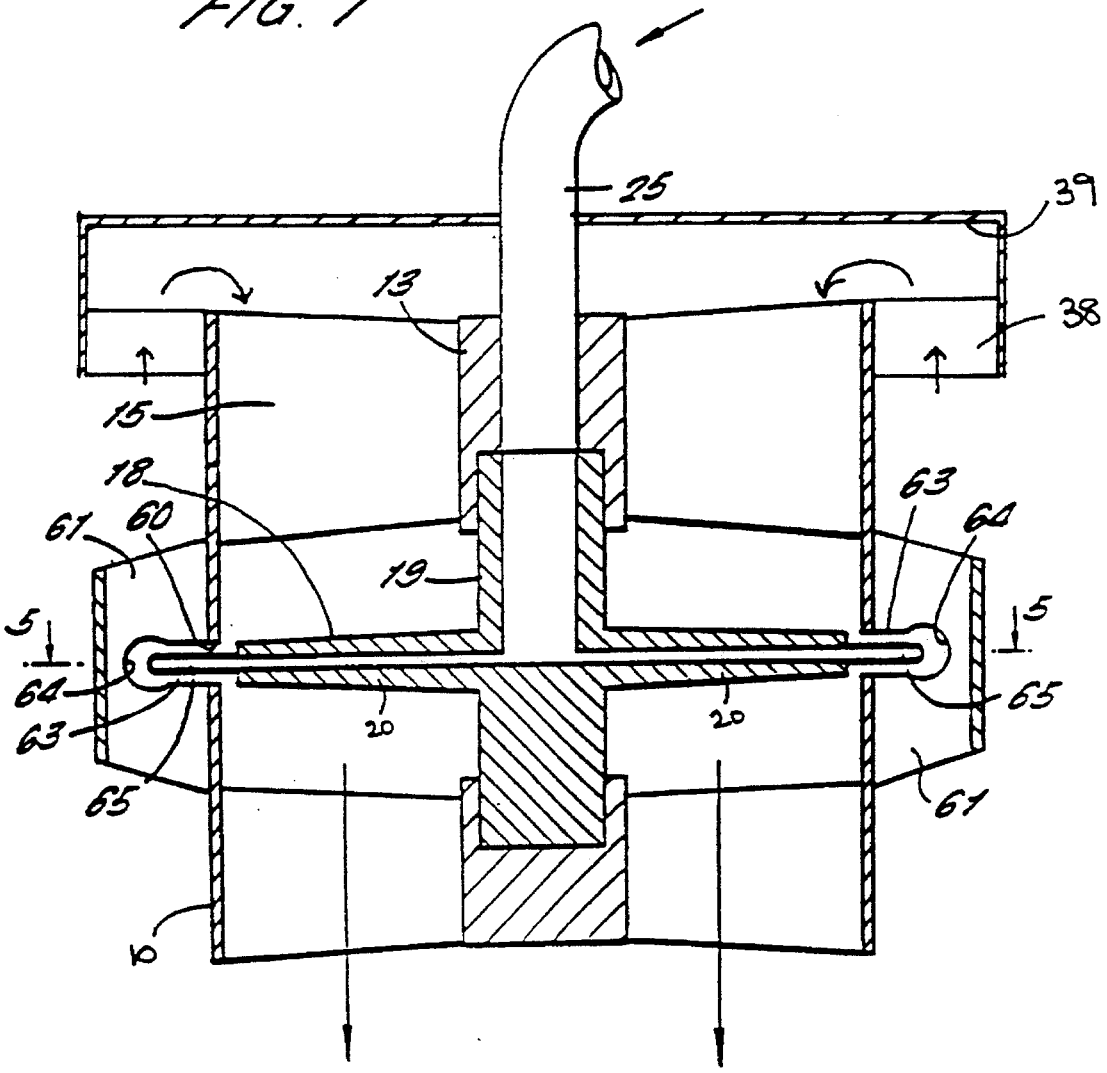
FIG. 7 illustrates a vertical section through the still further form of the underwater excavation apparatus showing the structure of the inlet facing in the opposite direction as the outlet.

Referring now to FIGS. 4, 5 and 7, a modified form of the excavation apparatus of FIGS. 1 and 2 is shown and like parts have been allotted the same reference numerals. The main difference is that the fixed vanes 31 on the inner side of tube 10 around the periphery of the propeller are omitted. Instead the tube is formed with a narrow annular slit 60 encircling the outer periphery of the propeller and vertically extending fixed vanes 61 are secured to the outer side of the tube extending across the slit at spaced locations around the tube as best see in FIG. 5. An annular sleeve 62 encircles and is secured to the outer peripheries of the vanes 61 to strengthen the structure. An annular chamber 67 is defined between the annular sleeve 62 and outer side of tube 10. Deep slots 63 extend into the vanes 62 from the slit in the tube, the bottoms of the slots being rounded as indicated at 64. The propeller blades 20 are formed with extended jet tubes 65 projecting from the outer peripheries of the blades to extend through the slit 60 in the tube and in alignment with the slots in the vanes. The jet tubes are turned to face tangentially of the propeller to direct the water jets there-from onto the vanes 62 and the static body of water lying between the vanes to cause the propeller to rotate and draw water through the tube as before. In this case however the jets do not act in the turbulent water flow passing through the tube under the action of the propeller as in the arrangements of FIGS. 1 to 3. A further benefit is gained for a given diameter of tube and propeller by the increase in the radius at which the jets act from the axis of the propeller, thereby increasing the torque generated on the propeller by the jets for a given water pressure.

Figure 6:
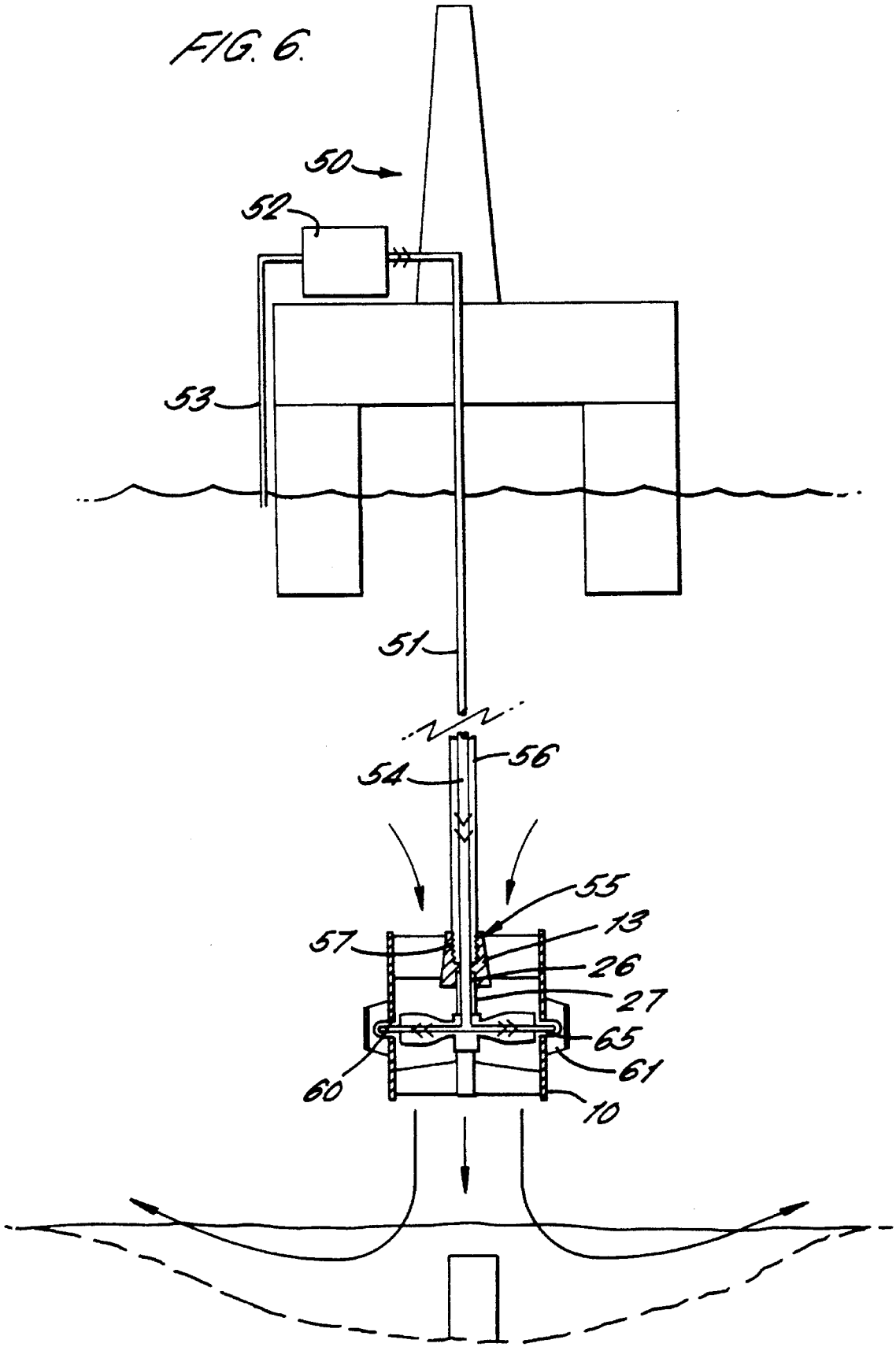
FIG. 6 illustrates the application of the excavation apparatus of FIGS. 4 and 5 to the lower end of a drill string extending downwardly from a drilling rig.

Referring now to FIG. 6 of the drawings, there is shown an application of the excavation apparatus of FIGS. 4 and 5 to a drill string. During "open hole" drilling from drilling rigs, the drill cuttings are dumped on the seabed and very often cover up the drill template and other structures. The present method of removing these cuttings (which may be up to 5 meters deep) is to use high pressure water pumped down the drill string through a "jet sub" tool. The tool is generally not very successful in clearing large areas and operators are very cautious in using them since the high pressure (high water velocity) can damage seafloor equipment. A better system is to wash the area with a very large flow of low velocity (non-destructive) water. This can be achieved by fitting the underwater excavation apparatus as described earlier directly to the drill string and using the high pressure of water supply to power it as will now be described in detail with reference to FIG. 6.

A drilling rig is indicated generally at 50 from which a drill string 51 depends. A high pressure water pump 52 is mounted on the deck of the drilling rig which draws water into an inlet conduit 53 from the sea and discharges water at high pressure through a central conduit 54 of the drill string.

The underwater excavation apparatus is mounted at the lower end 55 of the drill string and like parts have been given the same reference numerals. The outer sleeve 56 of the lower end of the drill string has an externally threaded portion 57 to engage in a screw threaded socket in the collar 13 at the upper end of the tube 10 to secure the excavator to the lower end of the sleeve of the drill string. The high pressure rotary coupling 26 of the excavator is housed in the lower end of the sleeve 13 instead of above the sleeve as in the previously described embodiment and the inner conduit 54 of the drill string is connected to the upper side of the coupling. The lower side of the coupling is connected by a conduit 17 to the propeller as before. The supply of high pressure water is thus communicated from the drill string to the blades of the jet prop.

The high pressure water jet delivered through the drill string exists from the jets at the outer periphery of the propeller to impinge on the vanes and static water between the vanes to cause the propeller to rotate drawing water downwardly through the conduit and delivering the water at the lower end of the conduit to act on the seabed as illustrated by the heavy arrows. Thus an object to be exposed or examined on the seabed prior to excavation can be exposed by the jet of water acting on the seabed to create a shallow trench on the seabed as illustrated.

What is claimed:

1. Underwater excavation apparatus comprising a hollow body having an inlet to receive water, an outlet for discharging water, a propeller having a plurality of blades mounted for rotation at a location in the hollow body to draw water through the inlet and deliver a stream of water through the outlet, water jet means on the propeller blades and means to supply water under pressure to the jet means to cause the propeller to rotate and thereby deliver a flow of water through the outlet for displacing material on the seabed; wherein the improvement comprises providing the hollow body with an encircling slit around the location of the propeller, an annular sleeve on the outer side of the hollow body with fixed vanes, means mounting the annular sleeve on the hollow body to extend on either side of said slit to define an annular chamber around the hollow body and locating said water jet means at the tip or tips of the propeller blades to project through the annular slit into said annular chamber and to face around the chamber to react on the water contained within the chamber.

2. Underwater excavation apparatus as in claim 1, wherein the water jet means are located at the tip or tips of the blades of the propeller and means are provided for feeding water under pressure from the center of the propeller to the jet means.

3. Underwater excavation apparatus as in claim 2, wherein the blades of the propeller are hollow to provide passages extending from the center of the propeller to the blade tips and said jet means at the blade tips are in communication with the passages.

4. Underwater excavation apparatus as in any one of claims 1 to 3, wherein the mounting means for the annular sleeve comprise fixed vanes disposed at spaced locations around the outer periphery of the body between the body and the annular sleeve and extending to either side of said slit in the hollow body, the vanes having slots extending into the vanes from the slit in the hollow body and the blades of the propeller have jets extending outwardly therefrom in alignment with the slots in the external vanes and said jets being turned to face tangentially of the propeller to impinge on the vanes so as to create a reaction force on the vanes which acts to oppose any tendency of the hollow body to rotate in the same direction as the propeller.

5. Underwater excavation apparatus as in claim 4, wherein the vanes are mounted on the hollow body to either side of said annular slit and the annular sleeve is mounted on the outer peripheries of the vanes.

6. Underwater excavation apparatus as in any one of claims 1 to 3, wherein the propeller is mounted on a shaft supported in spaced bearing hubs mounted in the hollow body, the shaft being hollow to provide a passageway from a supply of high pressure water to the jets on the propeller blades.

7. Underwater excavation apparatus as in claim 6, wherein the bearing hubs are mounted on radially extending vanes extending to the wall of the hollow body upstream, the vanes lying in planes extending along the hollow body to direct flow lengthwise along the hollow body and reduce swirl resulting from the action of the propeller.

8. Underwater excavation apparatus as claimed in claim 6, wherein the bearing hubs are mounted on radially extending vanes extending to the wall of the hollow body upstream and downstream of the propeller, the vanes lying in planes extending along the hollow body to direct flow lengthwise along the hollow body and reduce swirl resulting from the action of the propeller.

9. Underwater excavation apparatus as claimed in claim 6, wherein the bearing hubs are mounted on radially extending vanes extending to the wall of the hollow body downstream of the propeller, the vanes lying in planes extending along the hollow body to direct flow lengthwise along the hollow body and reduce swirl resulting from the action of the propeller.

10. Underwater excavation apparatus as in any one of claims 1 to 3, wherein the inlet to the hollow body faces in the opposite direction as the outlet whereby the reaction in the body when ejecting water through the outlet is countered by the reaction in drawing in water.

11. Underwater excavation apparatus as in claim 10, wherein the inlet encircles the hollow body adjacent one end thereof and means are provided to reverse the direction of flow into the inlet so as to be opposite to the direction of flow from the outlet.

12. Underwater excavation apparatus as in any one of claims 1 to 3, wherein buoyancy means are provided to render the apparatus buoyant underwater and anchor means are provided for holding the hollow body with the outlet facing downwardly to act on the seabed.

13. Underwater excavation apparatus as in any one of claims 1 to 3 in combination with a drill string in which the hollow body of the apparatus is mounted at the lower end of the drill string to displace material on the seabed below the drill string.

14. Underwater excavation apparatus as in claim 13, wherein the drill string includes a high pressure water supply extending axially down the center of the drill string and connected to the water jet means on the propeller of the excavation means to rotate that propeller and thereby creates the flow of water through the hollow body of the excavation apparatus directed at the seabed below the drill string.

* * * * *